US008591320B2

(12) United States Patent
Yang et al.

(10) Patent No.: US 8,591,320 B2
(45) Date of Patent: Nov. 26, 2013

(54) SYSTEM AND METHOD FOR MANAGING CASINO CHIP USING RFID

(75) Inventors: Hoe-Sung Yang, Daejeon (KR); Cheol Sig Pyo, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 13/556,695

(22) Filed: Jul. 24, 2012

(65) Prior Publication Data

US 2013/0217474 A1 Aug. 22, 2013

(30) Foreign Application Priority Data

Feb. 21, 2012 (KR) ..... 10-2012-0017664

(51) Int. Cl.
*A63F 9/24* (2006.01)

(52) U.S. Cl.
USPC ..... 463/25; 463/29; 463/31; 463/39; 463/43

(58) Field of Classification Search
USPC ..... 463/20, 25
See application file for complete search history.

(56) References Cited

U.S. PATENT DOCUMENTS

| | | | | |
|---|---|---|---|---|
| 4,531,187 | A * | 7/1985 | Uhland | 463/12 |
| 5,781,647 | A * | 7/1998 | Fishbine et al. | 382/100 |
| 6,267,671 | B1 * | 7/2001 | Hogan | 463/25 |
| 8,098,150 | B2 | 1/2012 | Zhang et al. | |
| 2002/0042298 | A1 * | 4/2002 | Soltys et al. | 463/29 |
| 2002/0147042 | A1 * | 10/2002 | Vuong et al. | 463/40 |
| 2003/0220136 | A1 * | 11/2003 | Soltys et al. | 463/25 |
| 2005/0272501 | A1 * | 12/2005 | Tran et al. | 463/29 |
| 2007/0194931 | A1 * | 8/2007 | Miller et al. | 340/572.7 |
| 2008/0009339 | A1 * | 1/2008 | Pat et al. | 463/25 |
| 2011/0018715 | A1 * | 1/2011 | Lee | 340/572.7 |
| 2011/0227703 | A1 * | 9/2011 | Kotab | 340/10.1 |
| 2012/0080845 | A1 * | 4/2012 | Emori et al. | 273/309 |
| 2012/0223811 | A1 * | 9/2012 | Wild et al. | 340/10.1 |

FOREIGN PATENT DOCUMENTS

| | | | |
|---|---|---|---|
| JP | 2008-292491 | A | 12/2008 |
| KR | 10-2007-0082397 | A | 8/2007 |
| KR | 10-2007-0087962 | A | 8/2007 |
| KR | 10-2009-0072280 | A | 7/2009 |
| KR | 10-2009-0081140 | A | 7/2009 |
| KR | 10-2010-0023366 | A | 3/2010 |

* cited by examiner

*Primary Examiner* — Tramar Harper
(74) *Attorney, Agent, or Firm* — Rabin & Berdo, P.C.

(57) ABSTRACT

When RF signals of a plurality of RFID tags installed in a plurality of casino chips are received through a plurality of reader antennas, a system for managing casino chips using RFID (radio frequency identification) estimates an angle of arrival of the received RF signals, calculates the number and positions of the plurality of casino chips by using the received RF signals and each estimated angle of arrival, and manages the plurality of casino chips by using the number and the positions of the plurality of casino chips.

10 Claims, 6 Drawing Sheets

| HOME CHIP | HOME CHIP | BETTING CHIP |
|---|---|---|
| GAMER A | X : 00<br>Y : 00 | X : 00<br>Y : 00 |
| GAMER B | X : 00<br>Y : 00 | X : 00<br>Y : 00 |
| GAMER C | X : 00<br>Y : 00 | X : 00<br>Y : 00 |
| GAMER D | X : 00<br>Y : 00 | X : 00<br>Y : 00 |

SYSTEM AND METHOD FOR MANAGING CASINO CHIP USING RFID

CROSS-REFERENCE TO RELATED APPLICATION

This application claims priority to and the benefit of Korean Patent Application No. 10-2012-0017664 filed in the Korean Intellectual Property Office on Feb. 21, 2012, the entire contents of which are incorporated herein by reference.

BACKGROUND OF THE INVENTION (a) Field of the Invention

The present invention relates to a system and method for managing casino chips using RFID.

(b) Description of the Related Art

RFID (radio frequency identification) as a non-contactless automatic recognition technique refers to a technique for recognizing an electronic tag attached to articles (or goods) by using a radio frequency. Such an RFID technique is also applied to recognition of a mass of tags, as well as to an electronic shelf.

Recently, in casinos, casino chips with an RFID tag installed therein and an RFID reader are utilized for operating games and security (or prevention of theft). Namely, an RFID tag is installed in casino chips, and a lower side of a casino table is divided into several regions and a plurality of RFID reader antennas are installed in the regions, respectively. Then, the RFID reader reads the casino chips by the regions to recognize betting of garners.

In this case, when the casino chips are accumulated to be piled high, output power of the RFID tag should be increased for the RFID reader antenna to recognize the casino chips. However, in a case in which a plurality of RFID reader antennas are installed in each of the divided regions at the lower side of the casino table, when output power of the RFID tag is increased, an RFID reader antenna of a corresponding region may read the casino chips of an adjacent region. Thus, the casino chips of each region cannot be accurately discriminated.

SUMMARY OF THE INVENTION

The present invention has been made in an effort to provide a system and method for managing casino chips using RFID having advantages of accurately discriminating casino chips of each region on a casino table.

An exemplary embodiment of the present invention provides a system for managing casino chips using RFID. The system for managing casino chips may include a plurality of RFID tags, a plurality of reader antennas, a plurality of angle of arrival (AOA) estimation units, and an RFID reader. The plurality of RFID tags may be mounted in a plurality of casino chips, respectively. The plurality of reader antennas may be mounted in a casino table, and receive an RF signal from at least one of the plurality of RFID tags. The plurality of angle of arrival estimation units may correspond to the plurality of reader antennas, respectively, and estimate an angle of arrival of an RF signal received via each reader antenna. The RFID reader may manage the plurality of casino chips by using the RF signals received by the respective reader antennas and the angles of arrival estimated from the RF signals.

The RFID reader may calculate the number of the plurality of casino chips by using the RF signals received by the plurality of reader antennas, and calculate positions of corresponding casino chips by using an angle of arrival estimated from the RF signals received by at least two reader antennas.

The system for managing casino chips may further include a position display unit. The position display unit may display the number and positions of the plurality of casino chips on casino table screen regions.

The position display unit may discriminate the number of valid casino chips of gamers and the number of bet casino chips of the gamers and display this in betting zones of the gamers.

The reader antennas may include at least two array antennas, respectively. The system for managing casino chips may further include a plurality of phase detectors configured to correspond to the plurality of reader antennas, and detect a phase difference between at least two antennas of a corresponding reader antennas, wherein the plurality of angle of arrival estimation units may estimate an angle of arrival of a corresponding RF signal by using a phase difference detected by each corresponding phase detector.

The plurality of phase detectors may be mounted in the reader antenna or the RFID reader, and the plurality of angle of arrival estimation units may be mounted in the reader antenna or the RFID reader.

Another embodiment of the present invention provides a method for managing casino chips by using RFID (radio frequency identification) in a casino chip management system. The method for managing casino chips may include: receiving RF signals from a plurality of RFID tags installed in a plurality of casino chips through a plurality of reader antennas; estimating angles of arrival of the RF signals received through the plurality of reader antennas; and calculating the number and positions of the plurality of casino chips by using the received RF signals and the angles of arrival.

The method may further include displaying the number and positions of the plurality of casino chips on a casino table screen.

Each of the plurality of reader antennas may include at least two array antennas. The estimating may include: detecting a phase difference between at least two array antennas; and estimating the angle of arrival by using the phase difference.

The plurality of reader antennas may be mounted in the casino table. The calculating may include: calculating the number of the plurality of casino chips by using the RF signals received by the plurality of reader antennas; and calculating a position of a corresponding casino chip by using an angle of arrival estimated from the RF signals received by at least two reader antennas among the plurality of reader antennas.

DETAILED DESCRIPTION OF THE EMBODIMENTS

Figure 1:
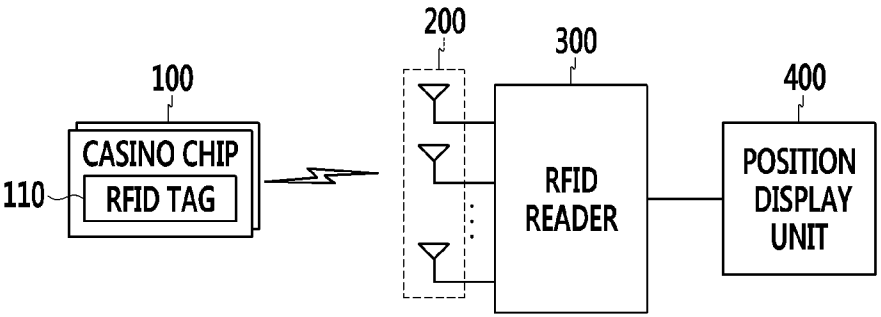
FIG. 1 is a view illustrating a system for managing casino chips using RFID according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification and claims, unless explicitly described to the contrary, the word "comprise" and variations such as "comprises" or "comprising" will be understood to imply the inclusion of stated elements but not the exclusion of any other elements.

A system and method for managing casino chips using RFID according to an embodiment of the present invention will be described in detail with reference to the accompanying drawings.

Figure 2:
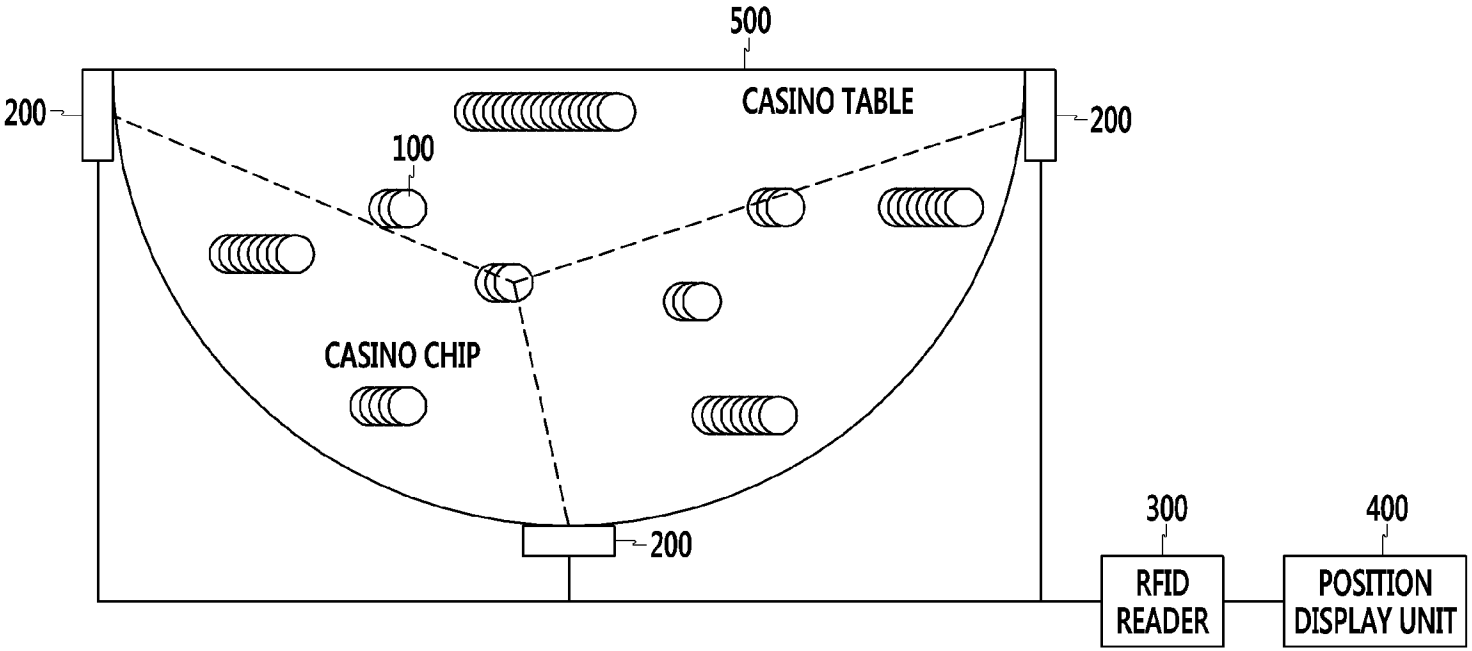
FIG. 2 is a view illustrating an example of a casino table according to an embodiment of the present invention.

FIG. 1 is a view illustrating a system for managing casino chips using RFID according to an embodiment of the present invention, and FIG. 2 is a view illustrating an example of a casino table according to an embodiment of the present invention.

With reference to FIGS. 1 and 2, the system for managing casino chips includes a plurality of casino chips 100, a plurality of reader antennas 200, and an RFID reader 300. Also, the system for managing casino chips may further include a position display unit 400.

An RFID tag 110 is installed in each of the plurality of casino chips 100. The RFID tag 110 stores information such as an identifier of a corresponding casino chip, a serial number of a corresponding casino chip, a manufacturer, and the like. When an RF signal is received from the RFID reader 100, the RFID tag 110 performs backscattered modulation on the received RF signal, stores the modulated signal, and transmits corresponding information to the RFID reader 300.

The plurality of reader antennas 200 radiate an RF signal generated from the RFID reader 300 to the plurality of RFID tags 110 by using a particular frequency band, e.g., a UHF RFID band (860 MHz to 960 MHz), and receive RF signals from the plurality of RFID tags 100 and transfer the received RF signals to the RFID reader 300.

As illustrated in FIG. 2, the plurality of reader antennas 200 may be installed in a casino table 500.

When RF signals are received from the RFID tags 110 installed in the plurality of casino chips 100, the plurality of reader antennas 200 measure an angle of arrival (AOA) of the received RF signals. Here, a position of a casino chip which has transmitted a corresponding RF signal may be calculated by using angles of arrival measured by at least two reader antennas 200 among the plurality of reader antennas 200, distances therebetween being known.

The RFID reader 300 checks identifiers of the casino chips from the RF signals received through the plurality of reader antennas 200, and calculates positions of the casino chips which have transmitted the corresponding RF signals by using the angle of arrival measured by the at least two reader antennas 200 among the plurality of reader antennas 200, distances therebetween being known. The positions of the casino chips calculated may thusly be displayed by the position display unit 400.

The RFID reader 300 manages all casino chips on the casino table 500 based on the identifiers of the casino chips and the positions of the casino chips.

By managing the casino chips by using the positions of the casino chips in this manner, although the plurality of reader antennas 200 recognize the same casino chip, the regions in which corresponding casino chips are positioned can be accurately identified. Thus, the RFID reader 300 can discriminate the number of valid casino chips of a gamer and the number of bet casino chips according to the types and numbers of casino chips distributed in a limited region, and manage the same.

The position display unit 400 displays the positions of casino chips through a screen.

Figure 3:
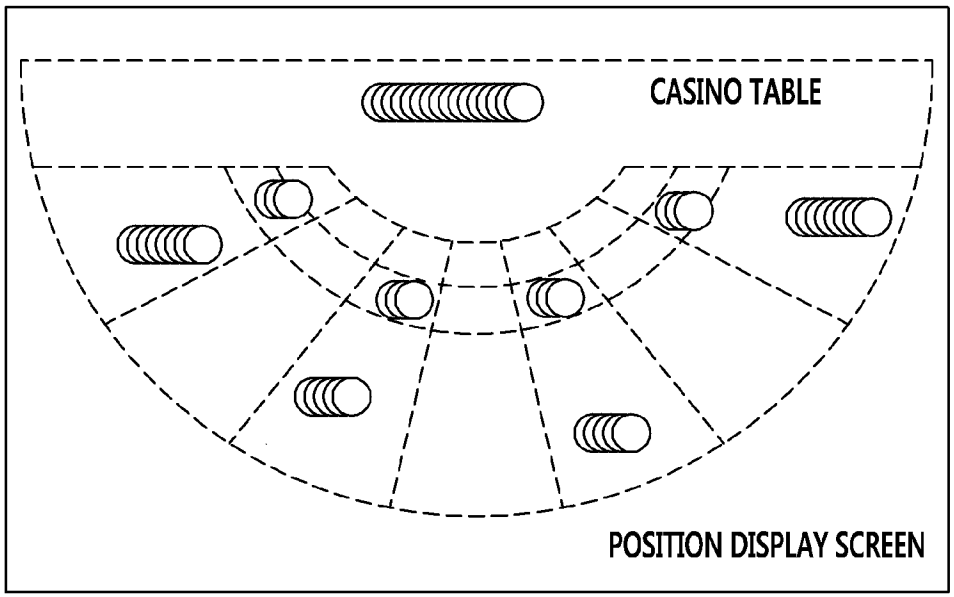
FIG. 3 is a view illustrating an example of a position display screen of a position display unit according to an embodiment of the present invention.

FIG. 3 is a view illustrating an example of a position display screen of a position display unit according to an embodiment of the present invention.

As illustrated in FIG. 3, the casino table region is divided into a plurality of betting zones according to garners, and the position display unit 400 displays positions of casino chips on the casino table screen region.

Also, the position display unit 400 may discriminate the number of valid casino chips of garners and the number of bet casino chips according to the types and number of casino chips and display relevant betting zones.

Figure 4:
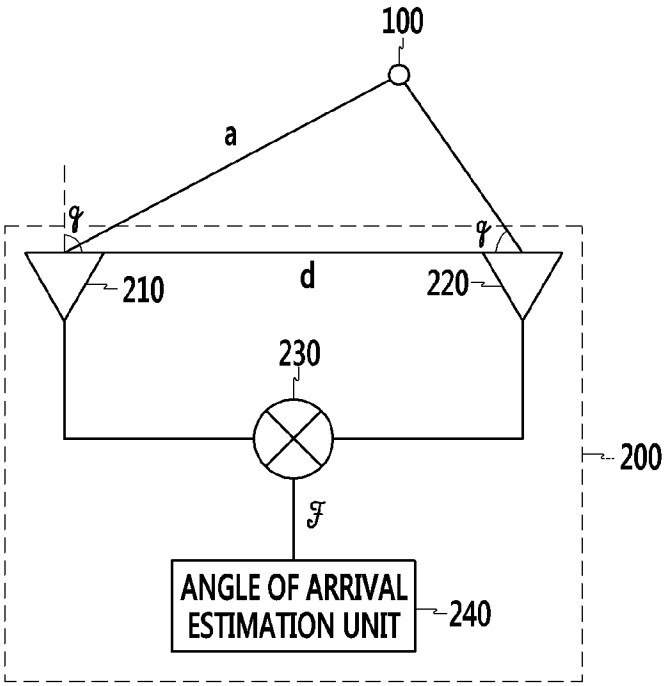
FIG. 4 is a view illustrating a method of measuring an angle of arrival (AOA) in a reader antenna according to an embodiment of the present invention.

FIG. 4 is a view illustrating a method of measuring an angle of arrival (AOA) in a reader antenna according to an embodiment of the present invention. In FIG. 4, a single reader antenna 200 is illustrated.

With reference to FIG. 4, a single reader antenna 200 includes two or more array antennas 210 and 220, a phase detector 230, and an angle of arrival estimation unit 240.

The array antennas 210 and 220 receive an RF signal from the RFID tag 110 installed in the casino chip 100. The array antennas 210 and 220 may be arranged in a row or in a circle. That is, the array antennas 210 and 220 may be arranged in various shapes.

The phase detector 230 detects a phase difference $\Phi$ of the RF signal received by the array antennas 210 and 220.

The angle of arrival estimation unit 240 estimates an angle of arrival $\theta$ of the RF signal received from the RFID tag 110 by using the phase difference $\Phi$ detected by the phase detector 230.

Here, the phase detector 230 and the angle of arrival estimation unit 240 may be independently implemented from the reader antenna 200 or may be implemented in the RFID reader 300. For example, when the phase detector 230 and the angle of arrival estimation unit 240 are implemented in the RFID reader 300, the angle of arrival $\theta$ is estimated by the RFID reader 300.

In FIG. 4, d is a distance between the antennas 210 and 220, a is a difference between signals which arrive at the antennas 210 and 220, and $\theta$ is an angle of arrival.

The angle of arrival $\theta$ may be calculated as expressed in Equation 1 shown below.

$$\theta = \arcsin\left(\frac{\Phi + n \cdot 2\pi}{2\pi \cdot k}\right) \quad n = 0, \pm 1, \pm 2, \ldots \qquad \text{[Equation 1]}$$

Here, $\Phi$ is an output from the phase detector 230, k is $d/\lambda$, and $\lambda$ is a wavelength.

The process of deriving Equation 1 is described as follows.

A time delay difference Δt between the antennas 210 and 220 may be calculated as expressed in Equation 2 shown below, and the difference (a) between the signals arriving at the antennas 210 and 220 may be calculated as expressed in Equation 3 shown below.

$$\Delta t = \frac{a}{c} \quad \text{[Equation 2]}$$

Here, c is a propagation speed.

$$a = d \cdot \sin(\theta) \quad \text{[Equation 3]}$$

The phase difference ϕ between the array antennas 210 and 220 may be calculated as expressed in Equation 4 shown below.

$$\begin{aligned} \phi &= \Delta t \cdot 2\pi \cdot \frac{c}{\lambda} \\ &= \frac{a}{c} \cdot 2\pi \cdot \frac{c}{\lambda} \\ &= 2\pi \cdot \frac{d}{\lambda} \cdot \sin(\theta) \\ &= 2\pi \cdot k \cdot \sin(\theta) \end{aligned} \quad \text{[Equation 4]}$$

Here, λ is a wavelength, and k is d/λ.

Also, an output from the phase detector 230 may be expressed as shown in Equation 5 below, and Equation 1 can be derived from Equation 5.

$$\Phi = \arg(e^{j \cdot 2\pi \cdot k \cdot \sin(\Theta)}) = \arctan(2\pi \cdot k \cdot \sin(\theta)) \quad \text{[Equation 5]}$$

Namely, since the phase detector detects Φ, the angle of arrival θ may be obtained through Equation 1 by using Φ detected by the phase detector 230.

In this manner, when the angles of arrival are estimated by at least two reader antennas 200 with respect to backspread RF signals of the RFID tags 110 installed in the single casino chip 100, the position of the corresponding casino chip 100 can be calculated.

Figure 5:
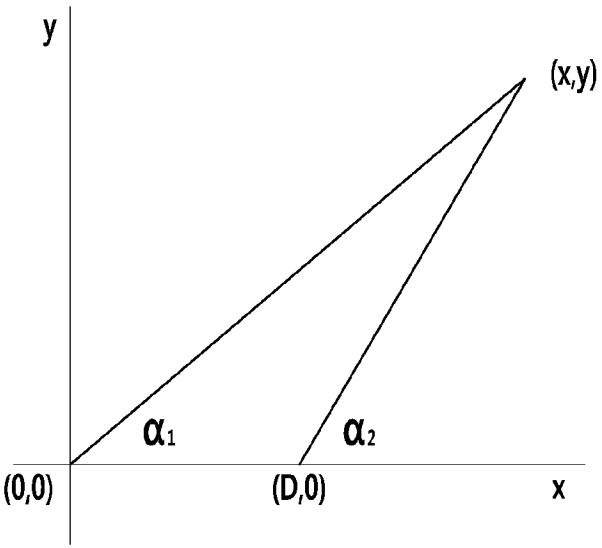
FIG. 5 is a graph for explaining a method of calculating a position of a casino chip in by an RFID reader according to an embodiment of the present invention.

FIG. 5 is a graph for explaining a method of calculating a position of a casino chip in by an RFID reader according to an embodiment of the present invention.

With reference to FIG. 5, when angles of arrival estimated by two reader antennas are α1 and α2, positions (x, y) of the corresponding casino chip 100 may be calculated as expressed by Equation 6 shown below.

$$\begin{aligned} x &= \frac{D \cdot \tan(\alpha_2)}{\tan(\alpha_2) - \tan(\alpha_1)} \\ y &= \frac{D \cdot \tan(\alpha_1) \cdot \tan(\alpha_2)}{\tan(\alpha_2) - \tan(\alpha_1)} \end{aligned} \quad \text{[Equation 6]}$$

Here, D is a distance between the two reader antennas.

Figure 6:
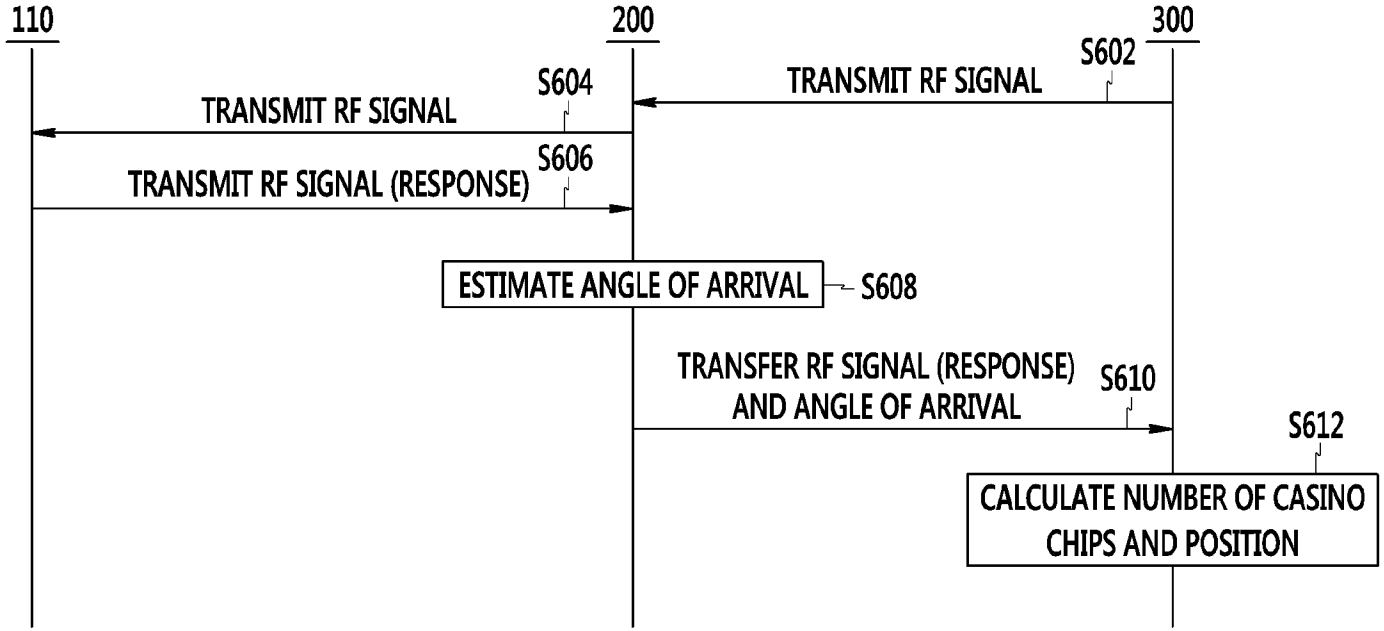
FIG. 6 is a view illustrating a method for managing casino chips by a system for managing casino chips according to an embodiment of the present invention.

FIG. 6 is a view illustrating a method for managing casino chips by a system for managing casino chips according to an embodiment of the present invention.

With reference to FIG. 6, the RFID reader 300 transmits RF signal to the plurality of RFID tags 100 installed in the plurality of casino chips 100 through the plurality of reader antennas 200 (S602, S604).

The plurality of tags 110 perform backspread modulation on the received RF signals, store the same, and transmit corresponding information in response, respectively (S606).

When the plurality of reader antennas 200 receive the RF signals from the plurality of RFID tags 110, they estimate angles of arrival (S608), and transfer the estimated angles of arrival and the received RF signals to the RFID reader unit 300 (S610).

The RFID reader 300 obtains information of the respective casino chips by using the RF signals received from the plurality of reader antennas 200, thereby calculating the number of casino chips and calculating the positions of the respective casino chips by using the angles of arrival estimated by the plurality of reader antennas 200 (S612).

The RFID reader 300 manages all the casino chips on the casino table by using the information, the number, and the positions of the respective casino chips.

According to an embodiment of the present invention, the positions of casino chips on a casino table during a game are recognized in real time, so the number and positions of casino chips retained by each gamer, casino chips present in the respective betting zones, and casino chips retained by a dealer can be accurately checked.

Also, since the RFID tag is installed in each of the casino chips, casino chips can be prevented from being unfairly or dishonestly used, and an error caused as a gamer erroneously calculates and bets can be prevented. Thus, the casino can be effectively operated.

The embodiments of the present invention may not necessarily be implemented only through the foregoing devices and/or methods, but may also be implemented through a program for realizing functions corresponding to the configurations of the embodiments of the present invention, a recording medium including the program, or the like, and such an implementation may be easily made by a skilled person in the art to which the present invention pertains from the foregoing description of the embodiments.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A system for managing casino chips using RFID (radio frequency identification), the system comprising:

a plurality of RFID tags mounted in a plurality of casino chips, respectively;

a plurality of reader antennas mounted in a casino table and configured to receive an RF signal from at least one of the plurality of RFID tags; and an RFID reader configured to manage the plurality of casino chips by using the RF signals received by the plurality of reader antennas;

wherein each of the plurality of reader antennas includes an AOA (angle of arrival) estimation unit configured to estimate an angle of arrival of an RF signal received;

wherein the RFID reader calculates the number of the plurality of casino chips by using the RF signals received by the plurality of reader antennas, and calculates positions of corresponding casino chips by using the angles of arrival estimated by the AOA estimation unit of each of the plurality of reader antennas; and wherein the RFID reader determines the number of valid casino chips of gamers and the number of bet casino chips of the gamers based on the number of the plurality of casino chips and the positions of corresponding casino chips.

2. The system of claim 1, further comprising a position display unit configured to display the number and positions of the plurality of casino chips on casino table screen regions.

3. The system of claim 2, wherein the position display unit is disposed in a gamer betting zone though a screen and displays the number of valid casino chips of gamers and the number of bet casino chips of the gamers.

4. The system of claim 1, wherein each of the plurality of reader antennas further includes at least two array antennas; and a phase detector configured to detect a phase difference between the at least two array antennas;

wherein the angle of arrival estimation unit estimates an angle of arrival of a corresponding RF signal by using a phase difference detected by the phase detector.

5. The system of claim 4, wherein:

the phase detector is mounted in the reader antenna or the RFID reader; and the angle of arrival estimation unit is mounted in the reader antenna or the RFID reader.

6. A method for managing casino chips by using RFID (radio frequency identification) in a casino chip management system, the method comprising:

using a reader antenna assembly to receive RF signals from a plurality of RFID tags installed in a plurality of casino chips through a plurality of reader antennas;

using an RFID reader to manage the plurality of casino chips by using the RF signals received by the plurality of reader antennas; and using an AOA (angle of arrival) estimation unit to estimate angles of arrival of the RF signals received;

wherein the RFID reader calculates the number of the plurality of casino chips by using the RF signals received by the plurality of reader antennas, and calculates positions of corresponding casino chips by using the angles of arrival estimated by the AOA estimation unit of each of the plurality of reader antennas; and wherein the RFID reader determines the number of valid casino chips of gamers and the number of bet casino chips of the gamers based on the number of the plurality of casino chips and the positions of corresponding casino chips.

7. The method of claim 6, further comprising displaying the number and positions of the plurality of casino chips on a casino table screen.

8. The method of claim 7, further comprising discriminating the number of valid casino chips of gamers and the number of bet casino chips of the gamers and displaying the same on betting zones of the gamers.

9. The method of claim 8, wherein each of the plurality of reader antennas further includes at least two array antennas, and the estimating includes:

detecting a phase difference between the at least two array antennas; and estimating the angle of arrival by using the phase difference.

10. The method of claim 6, wherein the plurality of reader antennas are mounted in the casino table, and the calculating includes:

calculating the number of the plurality of casino chips by using the RF signals received by the plurality of reader antennas; and calculating a position of a corresponding casino chip by using an angle of arrival estimated from the RF signals received by at least two reader antennas among the plurality of reader antennas.

* * * * *